US005337584A

United States Patent [19]

Angeli

[11] Patent Number: 5,337,584

[45] Date of Patent: Aug. 16, 1994

[54] INSERT FOR CONVERTING A BUTTON COVER FOR USE AS ANOTHER TYPE OF JEWELRY ARTICLE

[76] Inventor: Anthony E. Angeli, 182 Butler Ave., Providence, R.I. 02906

[21] Appl. No.: 971,935

[22] Filed: Nov. 5, 1992

[51] Int. Cl.[5] ..... A44C 13/00

[52] U.S. Cl. ..... 63/1.1; 63/12; 63/20; 24/113 R

[58] Field of Search ..... 63/1.1, 2, 14.1, 12, 63/20; 24/90.5, 113 MP, 113 R

[56] References Cited

U.S. PATENT DOCUMENTS

| | | | |
|---|---|---|---|
| 1,981,521 | 11/1934 | Mazer | 63/1.1 |
| 3,810,321 | 5/1974 | Kiba | 63/20 |
| 4,793,155 | 12/1988 | Law | 63/2 |
| 5,048,311 | 9/1991 | Mastrobuono | 63/20 |

FOREIGN PATENT DOCUMENTS

| | | | |
|---|---|---|---|
| 9111934 | 8/1991 | World Int. Prop. O. | 63/12 |

*Primary Examiner*—Flemming Saether

*Attorney, Agent, or Firm*—Salter & Michaelson

[57] ABSTRACT

A convertible jewelry article includes a button cover and a pair of inserts for converting the button cover for use as a pin or a clip-on earring. The button cover includes a cover portion having an open back and a back plate hinged to the cover so that it is hingeably received over the open back. The back plate includes an opening for receiving button attachment means therein, and resilient clip members for releasably maintaining the back plate in closed relation over the open back. The pin insert includes an insert body, a raised surface on one side thereof and a pin projecting outwardly from the raised surface. The earring insert is generally similar but includes a spring loaded earring clamp instead of a pin. Both of the inserts are adapted to be received in the cover portion so that the raised surface is received in interfitting engagement with the opening in the back plate when the back plate is in closed relation over the open back of the button cover. When assembled with the button cover, the pin or the earring clamp extends outwardly of the back plate through the opening therein.

13 Claims, 1 Drawing Sheet

INSERT FOR CONVERTING A BUTTON COVER FOR USE AS ANOTHER TYPE OF JEWELRY ARTICLE

BACKGROUND OF THE INVENTION

The instant invention relates to the jewelry art and more particularly to a convertible jewelry article.

It has heretofore been found highly desirable to be able to convert one type of jewelry article into another. In this regard, convertible jewelry articles of many types are well known in the jewelry art and provide many advantages to the wearer in that they allow the wearer to obtain many different uses from a single ornamental member, and therefore convertible jewelry articles have been found to be extremely popular.

SUMMARY OF THE INVENTION

The instant invention provides a convertible jewelry article comprising a button cover and a pair of inserts for converting the button cover for use as either a pressure-clip earring, or as a pin or brooch.

The button cover comprises an ornamental cover portion having an open back, and a back plate which is hingeably connected to the cover portion so that it hingeably closes over the open back. The back plate includes an opening through which the threads or other attachment means for the button extends, and further includes resilient clip members which releasably maintain the back plate in closed position on the cover portion.

A first insert is operable for converting the button cover for use as a pin or brooch and it includes an insert body which has opposite first and second sides, a raised surface on the first side which generally corresponds in shape to the opening in the back plate, and a pin extending outwardly from the raised surface. The insert body is adapted to be received in the cover portion of the button cover so that the first side is positioned adjacent the open back and so that the raised surface is received in interfitting engagement with the opening in the back plate when the back plate is received in its closed position, with the pin extending outwardly of the button cover through the opening in the back plate. In use, the pin is extended through a garment and a conventional butterfly clutch or the like is frictionally received over the terminal end of the pin to secure the assembly to the garment.

A second insert is operative for converting the button cover for use as a clip-on earring, and it comprises an insert body and a spring loaded earring clamp arm. The insert body is essentially identical to the aforesaid insert body except that there is no pin extending outwardly from the raised surface. Instead, the spring loaded earring clamp arm is secured to the first surface of the insert body and when the insert body is received in the button cover, the clamp arm extends outwardly of the button cover through the opening in the back plate. For use as a clip-on earring, the back plate of the button cover is positioned on the outer side of a wearer's earlobe and the spring loaded clamp arm element is positioned on the opposite side of the earlobe so that the earlobe is received therebetween in the normal manner associated with clip-on earrings.

Accordingly, it is an object of the instant invention to provide a convertible jewelry article.

It is another object to provide a button cover which is convertible for use as different articles of jewelry.

It is still another object to provide an insert for converting a button cover for use as an earring.

It is yet another object to provide an insert for converting a button cover for use as a pin.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DESCRIPTION OF THE PREFERRED EMBODIMENTS

Figure 1:
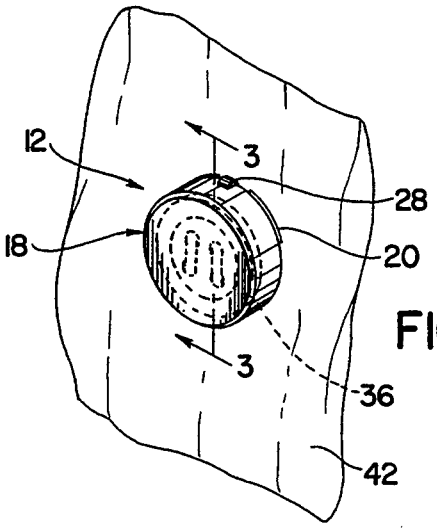
FIG. 1 is a perspective view of the convertible button cover of the instant invention mounted on a button of an article of clothing.
Figure 2:
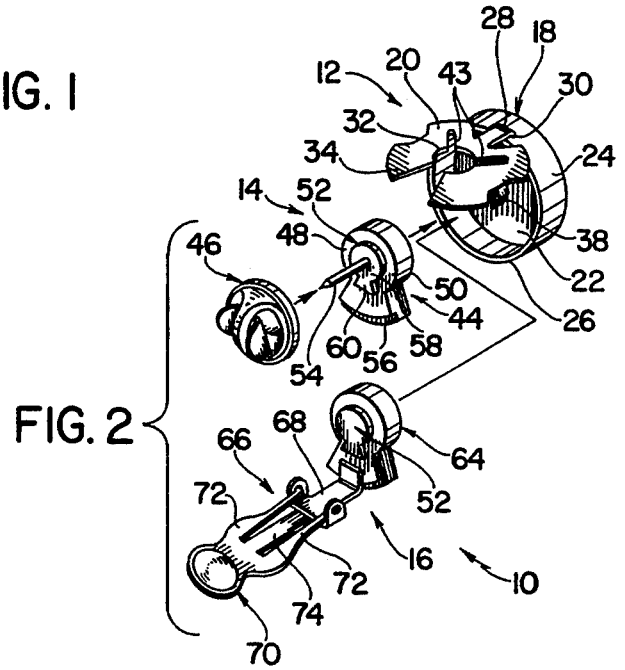
FIG. 2 is an exploded perspective view of the button cover and the inserts, one of which is operative for converting the button cover for use as a pin and the other of which is operable for converting the button cover for use as an earring.
Figure 3:
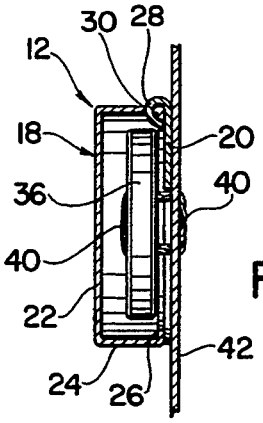
FIG. 3 is a cross sectional view of the button cover taken along line 3—3 in FIG. 1.

Referring now to the drawings, the convertible jewelry article of the instant invention is illustrated and is generally indicated at 10 in FIG. 2. The convertible jewelry article comprises a button cover generally indicated at 12, a first insert generally indicated at 14 and a second insert generally indicated at 16. The button cover 12 comprises a cover portion generally indicated at 18 and a back plate indicated at 20. The cover portion 18 includes a circular front wall 22 and a cylindrical side wall 24 extending rearwardly from the front wall 22. The cylindrical wall 24 terminates in a rolled lip 26 which defines an open back. The front wall 22 of the cover portion 18 is preferably decorated with an ornamental design, or alternatively, the cover portion 18 may be fixedly attached to the rear side of a decorative ornament (not shown). The back plate 20 is generally circular in shape and it is hingeably connected to the cover portion 18 by means of a reversely bent tab 28. The tab 28 is extended through a slot 30 in the cylindrical side wall 24 of the cover portion 18 so that the back plate 20 hingeably closes over the open back. The back plate 20 includes a key hole shaped opening comprising a centrally located aperture 32 and a divergent slot 34 extending therefrom for receiving the attachement means for a button 36, and it further includes resilient clip members 38 which are operative for releasably maintaining the back plate 20 in closed relation over the open back of the cover portion 18. In this regard, the clip members 38 are snap-received in frictional engagement with the rolled lip 26 of the cylindrical wall 24 when the back plate 20 is moved to its closed position. The button cover 12 is operable for use as a conventional button cover, as illustrated in the drawing FIGS. 1 and 3. For use in this connection, the back plate 20 is slidably positioned over the button 36 wherein the button's attachment means, namely the sewn threads 40 which hold the button 36 to the underlying garment 42 pass through the slot 34 and are received in the central aperture 32. The cover portion 18 is then closed over the back plate 20 so that the resilient clip members 38 frictionally engage with the rolled lip 26 thereof. Elongated slots 43 extends from aperture 32 to enhance the flexibility and resilience of plate 20.

Figure 4:
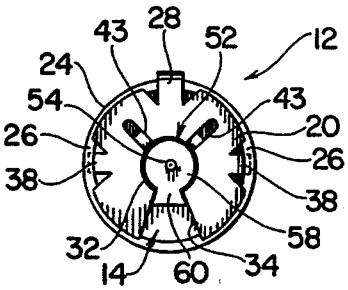
FIG. 4 is a rear view of the button cover with the pin insert received in engagement therewith.
Figure 5:
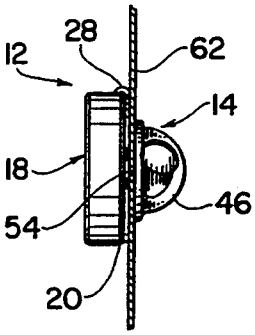
FIG. 5 is a side view of the button cover and pin insert mounted on an article of clothing.

The first insert 14 is operable for converting the button cover 12 for use as a pin or brooch and it comprises an insert body generally indicated at 44 adapted to be used with a conventional butterfly clutch generally indicated at 46. The insert body 44 generally corresponds in shape to a keyhole and it has a thickness generally equal to the depth of the cylindrical side wall 24 of the cover portion 18. The insert body has opposite first and second sides, 48 and 50, respectively, a raised surface generally indicated at 52 on the first side 48, a pin 56 extending outwardly from the raised surface 32 and a shallow notch 56 formed along an outer peripheral edge thereof. The raised surface 52 comprises a circular disk portion 58 generally corresponding in diameter to the aperture 32 of the back plate 20 and a divergent stem portion 60 generally corresponding in dimension to the slot 34 of the back plate 20. The insert body 44 is adapted to be received in the cover portion 18 of button cover 12 so that the second side 50 thereof is adjacent the front wall 22, the first side 48 thereof is adjacent the open back, and the notch 56 thereof interengages with the rolled lip 26 of the cylindrical wall 24. When the back plate 20 is received in closed relation over the open back, the raised surface 52 is received in interfitting engagement with the aperture 32 and slot 34 of the back plate 20 to secure the insert body 44 in position. More specifically, the disk portion 58 of the raised surface 52 is received in the central aperture 32 of the back plate 20 and the stem portion 60 of the raised surface 52 is received in the slot 34 of the back plate 20. (See FIG. 4). In this way, the insert 44 is securely received in the button cover 12 and the pin 54 extends outwardly through the aperture 32 in the back plate 20. It will be seen that the stem portion 60 of the raised surface 52 interlocks with the opposite walls of the slot 34 and effectively prevents the insert 44 from rotating within the button cover 12. For use of the insert 14 and button cover 12 as a lapel or stick pin (see FIG. 5), the pin 54 is extended through a garment 62, and the butterfly clutch 46 is frictionally received over the terminal end of the pin 54 to secure the assembly in position on the garment 62.

The second insert 16 is operable for converting the button cover 12 for use as a clip-on earring, and it comprises an insert body generally indicated at 64 and a spring loaded earring clamp arm generally indicated at 66 mounted to the insert body 64. The insert body 64 is substantially identical to the afore described insert body 44 except that the insert body 64 does not include the pin 54 extending outwardly from the raised surface 52. Instead, the spring loaded earring clamp arm 66 is secured to the first side of the insert body 64. The spring loaded earring clamp arm 66 is well known in the art, and it generally comprises a bracket 68 which is mounted to the first side of the insert body 64, and a spring loaded clamp arm element generally indicated at 70. The clamp arm element 70 includes a pair of spaced legs 72 which are rotatably mounted to the bracket 68 and a central spring arm 74 which engages with the bracket 68 for spring loading thereof.

Figure 6:
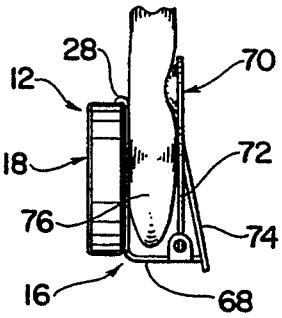
FIG. 6 is a rear view of the button cover and earring insert mounted on a wearer's ear.

As previously described for the first insert assembly 14, the second insert body 64 is adapted to be received in the cover portion 18 of the button cover 12. The raised surface 52 on the first side 48 of the insert 16 is then received in interfitting engagement with the aperture 32 and slot 34 in the back plate 20 when the back plate 20 is received in closed relation over the open back. In this regard, the earring clamp 66 extends outwardly of the button cover 12 through the slot 34 in the back plate 20. In use of the insert 16 and button cover 12 as a clip-on earring (see FIG. 6), the back plate 20 of the button cover 12 is positioned on the outer side of a wearer's earlobe 76, and the spring loaded clamp element 70 is positioned on the inner side of the earlobe 76 so that the earlobe 76 is received therebetween in the normal manner associated with clip-on earrings.

It is seen therefore, that the instant invention provides an effective convertible jewelry article. The convertible jewelry article 10 comprises a button cover 12 and includes a pair of inserts 14 and 16 which; are specially adapted to be received in the cover portion 18 of the button cover 12 for conversion of the button cover 12 for use as an alternative type of jewelry article. The button cover can be used by itself according to it's normal function as a button cover. To convert the button cover for use as alternative types of jewelry articles, a first insert 14 is provided for converting the button cover 12 for use as a pin, and a second insert 16 including a clip-on earring clamp 66 is provided for converting the button cover 12 for use as a clip-on earring. The pin and earring inserts 14 and 16 are easily assembled and disassembled with the button cover 12 for easy conversion. Further, it can be appreciated that an insert could be adapted for converting the button cover 12 for uses such as lapel pins, tie pins, pierced earrings, etc. For these reasons, it is believed that the convertible jewelry article 10 of the instant invention represents significant advancements in the jewelry art which have substantial commercial merit.

While there is shown and described herein certain specific structure embodying the invention it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A convertible jewelry article comprising:

a button cover comprising a cover portion having a recessed opening in a back side thereof for receiving a button therein, a back plate operable to cover said recessed opening in said button cover, said back plate having an opening therein for receiving button attachment means, said opening comprising a circular central aperture and an outwardly diverging slot extending radially therefrom, and means for releasably maintaining said back plate in closed relation over said recessed opening; and an insert comprising an insert body having opposite first and second sides and a thickness substantially equal to a depth of said recessed opening in said ornament, said insert body further having a raised surface on said first side comprising a centrally located disk portion and an outwardly tapering stem portion extending radially therefrom, and means on said first side for converting said button cover for use as another type of jewelry article, said insert body being received in said recessed opening in said cover portion so that said first side is adjacent said back plate and so that said raised disk and stem portions are received in interfitting engagement with said circular central aperture and said outwardly tapering slot in said back plate when said back plate is received in closed relation over said recessed opening, said means for converting said button cover extending outwardly through said back plate.

2. In the convertible jewelry article of claim 1, said means for converting said button cover comprising pin means extending outwardly from said first side.

3. In the convertible jewelry article of claim 1, said means for converting said button cover comprising means for securing said insert to an ear.

4. In the convertible jewelry article of claim 3, said means for securing comprising clip-on securing means.

5. In the convertible jewelry article of claim 4, said clip-on securing means comprising a bracket mounted to said first side of said insert body and a spring loaded clamp element, said clamp element having a pair of spaced legs rotatably connected to said bracket and a central spring arm which engages with said bracket for spring loading thereof.

6. In the convertible jewelry article of claim 1, said back plate being hingeably connected to said cover portion so as to hingeably close over said open back.

7. An insert for converting a button cover for use as another type of jewelry article, wherein said button cover is of the type comprising a cover portion having a recessed opening in a back side thereof for receiving a button therein, a back plate operable to cover said recessed opening, said back plate including an opening therein for receiving button attachment means, said opening comprising a circular central aperture and an outwardly diverging slot extending radially therefrom, and means for releasably maintaining said back plate in closed relation over said recessed opening, said insert comprising:

an insert body having opposite first and second sides, and a thickness substantially equal to a depth of said recessed opening in said button cover;

a raised surface on said first side comprising a centrally located disk portion and an outwardly tapering stem portion extending radially therefrom; and means on said first side for converting said button cover for use as another type of jewelry article, said insert being received in said recessed opening so that said first side is adjacent said back plate and so that said raised disk and stem portions are received in interfitting engagement with said central aperture and said diverging slot in the back plate when said back plate is received in closed relation over said recessed opening, said means for converting said button cover extending outwardly through said back plate.

8. In the insert of claim 7, said means for converting said button cover comprising means for securing said insert to an ear.

9. In the insert of claim 8, said means for securing said insert to an ear comprising clip-on securing means.

10. In the insert of claim 9, said clip-on securing means comprising a bracket mounted to said first surface and a spring loaded clamp element, said clamp element having a pair of spaced legs rotatably connected to said bracket, and a central spring arm which engages with said bracket for spring loading thereof.

11. In the insert of claim 7, said means for converting said button cover comprising pin means extending outwardly from said first side.

12. In the insert of claim 7, said back plate being hingeably connected to said cover portion so as to hingeably close over said open back.

13. In combination, a button cover and an insert for converting said button cover for use as another type of jewelry article, said button cover comprising a cover portion having a recessed opening in a back side thereof for receiving a button therein, a back plate which is hingeably connected to said cover portion so as to hingeably close over said recessed opening, said back plate having an opening therein for receiving button attachment means, said opening comprising a circular central aperture and an outwardly diverging slot extending radially therefrom, and means for releasably maintaining said back plate in closed relation over said recessed opening;

said insert comprising an insert body having opposite first and second sides and a thickness substantially equal to a depth of said recessed opening in said button cover, said insert body further having a raised surface on said first side comprising a centrally located disk portion and an outwardly tapering stem portion extending radially therefrom, and means on said first side for converting said button cover for use as another type of jewelry article, said insert body being received in said recessed opening in said cover portion so that said first side is adjacent said back plate and so that said raised disk and stem portions are received in interfitting engagement with said circular central aperture and said outwardly diverging slot in said back plate when said back plate is received in closed relation over said recessed opening, said means for converting said button cover extending outwardly through said back plate.

* * * * *